US006161233A

United States Patent [19]

von Schroeter et al.

[11] Patent Number: 6,161,233

[45] Date of Patent: Dec. 19, 2000

[54] CHASSIS

[75] Inventors: Philip von Schroeter, Haresfield; Raymond Charles Williams, Churchdown, both of United Kingdom

[73] Assignee: Arjo Limited, Gloucester, United Kingdom

[21] Appl. No.: 09/412,023

[22] Filed: Oct. 5, 1999

[30] Foreign Application Priority Data

Oct. 27, 1998 [GB] United Kingdom ..... 9823366

[51] Int. Cl.[7] ..... A61G 7/14

[52] U.S. Cl. ..... 5/86.1; 5/81.1 R

[58] Field of Search ..... 5/86.1, 81.1 R, 5/83.1; 248/346.07

[56] References Cited

U.S. PATENT DOCUMENTS 3,877,421 4/1975 Brown ..... 5/86.1

FOREIGN PATENT DOCUMENTS 0 241 096 10/1987 European Pat. Off. .
967277 8/1964 United Kingdom .
2 082 986 3/1982 United Kingdom .

*Primary Examiner*—Alexander Grosz
*Attorney, Agent, or Firm*—Young & Thompson

[57] ABSTRACT

A chassis comprises two legs extending in parallel spaced apart relationship and a cross member connecting the two legs together. The cross member comprises first, second and third tubular members. The second member is telescopically extendible and retractable in the first member and the third member is telescopically extendible and retractable in the second member. A linear actuator is provided for extending and retracting the second and third members in opposite directions relative to the first member.

14 Claims, 3 Drawing Sheets

18
19
15
12
17
10
20
14
20
16
13
11
20

FIG 3A
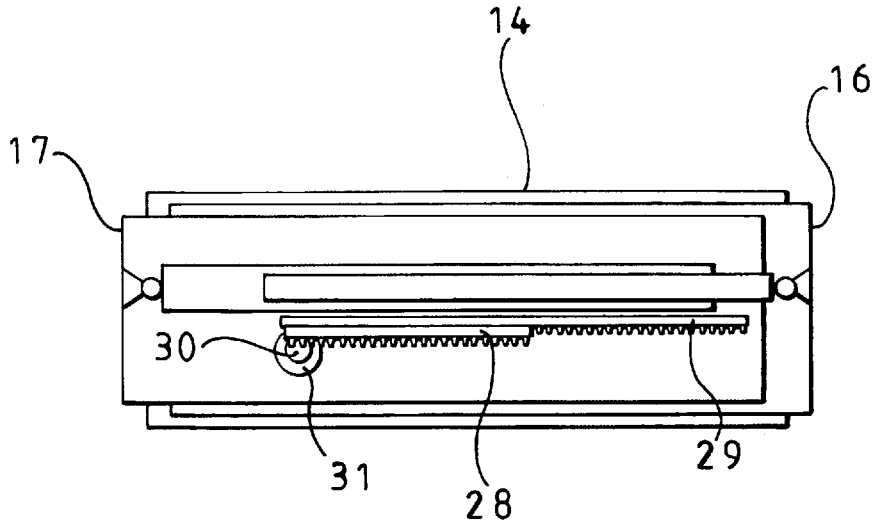
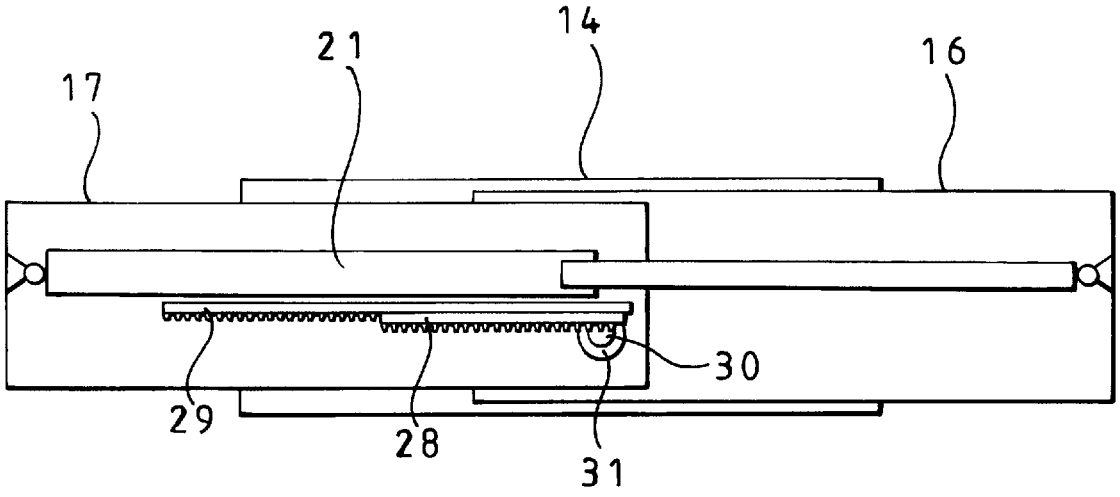
FIG 3B

CHASSIS

INTRODUCTION

This invention relates to a chassis and more particularly, but not exclusively, to a chassis for an invalid hoist.

It is known to provide an invalid hoist with a chassis having two legs and a cross member connecting one end of each leg together. The legs normally extend parallel to one another but it is known to provide a chassis in which the legs can pivot outwardly so that they diverge towards the open end of the chassis, namely that end remote from the cross member. This is to enable the chassis to fit around a chair or wheel chair when the legs are pivoted outwards and yet pass easily through a door opening when the legs extend parallel to one another. It is also known to provide a chassis in which the legs can be moved away from one another while remaining parallel to one another. The problem with this latter known chassis is that the range of movement is limited.

The present invention seeks to provide an improved chassis of the type in which the legs can be moved away from one another while remaining in parallel with one another.

SUMMARY OF THE INVENTION

According to the present invention there is provided a chassis comprising two legs extending in parallel or substantially parallel spaced apart relationship and a cross member connecting the two legs together, the cross member comprising first, second and third members, actuator means for extending and retracting the second and third members relative to one another and means for defining the position of the first member relative to the second and third members.

Preferably, said defining means ensure that the second and third members extend and retract in opposite directions relative to the first member at equal or substantially equal rates of movement. In this case, said defining means may comprise two pinion gears supported for rotation by one of the members and two racks supported respectively by the other two members. In this case, preferably, the pinions are mounted on opposite ends of a shaft supported for rotation by the second member and the racks are supported respectively by the first and third members and are engaged by respective pinions.

Preferably, the actuator means comprises a linear actuator, typically an electromechanical linear actuator, which may act between the second and third members.

Preferably, the first, second and third members are tubular members and the second member is telescopically extendible and retractable in the first member and the third member is telescopically extendible and retractable in the second member.

Preferably, the actuator means is housed within the cross member and, in this case, bus bars and sliding contacts are preferably provided between the first and second members and between the second and third members to conduct electricity from externally of the cross member to the actuator means.

Preferably, low friction pads are provided between the first member and the second member and between the second member and the third member.

Preferably, the chassis forms part of an invalid hoist and the first member supports a mast. In this case, a lifting arm may be provided on the mast.

The invention will now be more particularly described, by way of example, with reference to the accompanying drawings.

BRIEF DESCRIPTION OF THE DRAWINGS

FIG. 2 is a cross section taken through the chassis and FIGS. 3A and 3B are is a schematic views showing the operation of the chassis.

DESCRIPTION OF THE PREFERRED EMBODIMENT

Figure 1:
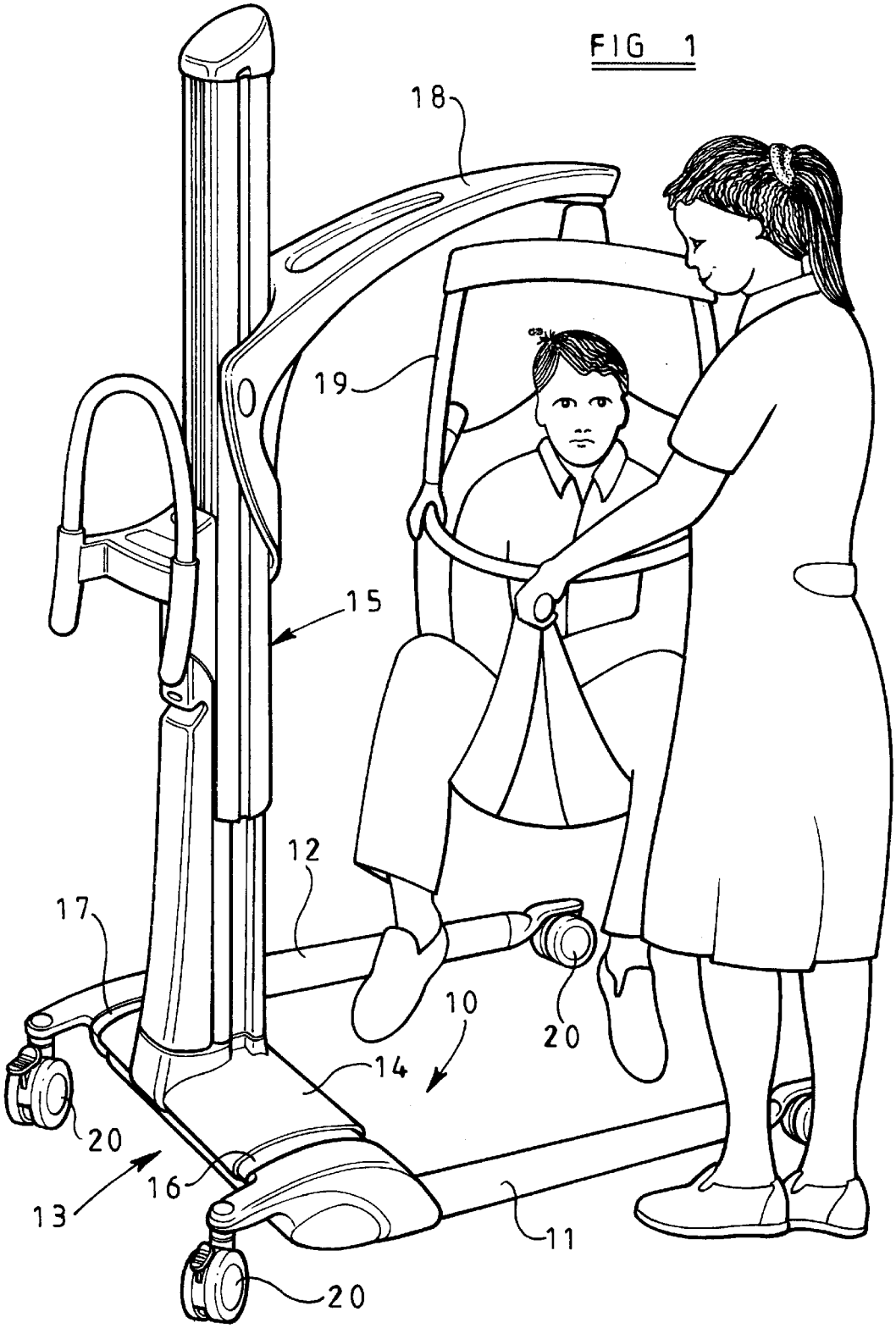
FIG. 1 is a perspective view of an invalid hoist provided with one embodiment of a chassis according to the present invention.
Figure 2:
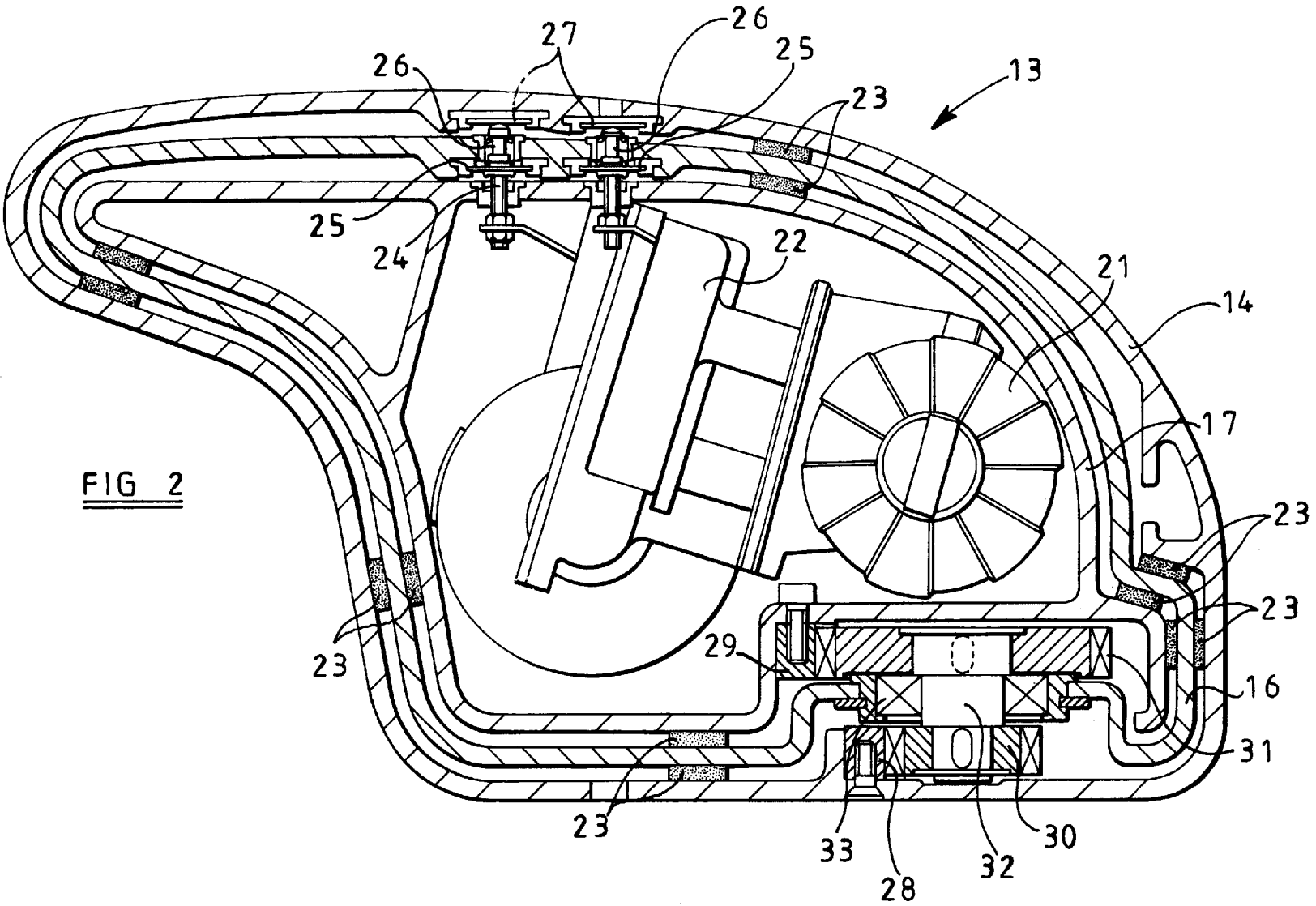

Referring to the drawings, the invalid hoist comprises a chassis 10 having two legs 11 and 12 and a cross member 13.

The cross member 13 comprises a first outer tubular member 14 which supports an upstanding mast 15, a second intermediate tubular member 16 telescopically extendible and retractable in the first member 14 and a third inner tubular member 17 telescopically extendible and retractable in the second intermediate tubular member 16. One end of the intermediate tubular member 16 is connected to the leg 11 and one end of the inner tubular member 17 is connected to the leg 12.

The mast 15 supports a lifting arm 18 which has a sling hanger 19 at its free end. Each leg 11, 12 has two castors 20, one at either end. The second and third tubular members 16 and 17, respectively, are extendible and retractable relative to the first tubular member 14 by an electro mechanical linear actuator 21 housed within the cross member 13. The actuator 21 is powered by an electric motor 22 and is connected between the said one end of the intermediate tubular member 16 and the said one end of the inner tubular member 17. Low friction pads 23 are provided between the outer tubular member 14 and the intermediate tubular member 16 and also between the intermediate tubular member 16 and the third tubular member 17.

The motor 22 of the actuator 21 is fixed to the inner tubular member 17. In order to conduct electricity to the motor 22, the inner tubular member 17 is provided with two spring loaded contacts 24 which are urged against respective busbars 25 supported by the intermediate tubular member 16 and the intermediate tubular member 16 is provided with two spring loaded contacts 26 which are connected to respective busbars 25 and which are urged against respective busbars 27 supported by the outer tubular member 14.

An arrangement is provided to ensure that the first member 14 is always centrally located with respect to the two legs 11, 12. This is achieved by ensuring that the first member 14 moves at half the rate of the second member 16 relative to the third member 17. This arrangement comprises two racks 28 and 29 secured respectively to the outer tubular member 14 and the inner tubular member 17 and two pinion gears 30 and 31 fixed to opposite ends of a shaft 32 which is rotatable in a bearing 33 supported by the intermediate tubular member 16.

The pinion 30 engages with the rack 28 and the pinion 31 engages with the rack 29. The pinion 31 has twice as many teeth as the pinion 30 to provide a one to two gear ratio. As the actuator 21 extends it will move the intermediate tubular member 16. This will cause the pinion 31 and hence the shaft 32 to rotate. The pinion 30 will also rotate to move the rack 28 and hence the outer member 14 at half the rate of movement of the intermediate member 16.

A chassis as described above has a larger range of movement than known chassis of the type in which the legs remain in parallel with one another.

The embodiment described above is given by way of example only and various modifications will be apparent to persons skilled in the art without departing from the scope of the invention. For example, the first, second and third members 14, 16 and 17, respectively, need not necessarily be tubular members.

What is claimed is:

1. A chassis comprising two legs extending in parallel or substantially parallel spaced apart relationship and a cross member connecting the two legs together, the cross member comprising first, second and third members, actuator means for extending and retracting the second and third members relative to one another and means for defining the position of the first member relative to the second and third members, said defining means comprising two pinion gears supported for rotation by one of the members and two racks supported respectively by the other two members.

2. A chassis as claimed in claim 1, wherein said defining means ensure that the second and third members extend and retract in opposite directions relative to the first member at equal or substantially equal rates of movement.

3. A chassis as claimed in claim 1, wherein the pinions are mounted on opposite ends of a shaft supported for rotation by the second member and the racks are supported respectively by the first and third members and are engaged by respective pinions.

4. A chassis as claimed in claim 1, wherein the actuator means comprises a linear actuator.

5. A chassis as claimed in claim 4, wherein the actuator is an electro mechanical linear actuator.

6. A chassis as claimed in claim 4, wherein the linear actuator acts between the second and third members.

7. A chassis as claimed in claim 1, wherein the first, second and third members are tubular members and wherein the second member is telescopically extendible and retractable in the first member and the third member is telescopically extendible and retractable in the second member.

8. A chassis as claimed in claim 7, wherein the actuator means is housed within the cross member.

9. A chassis as claimed in claim 8, wherein busbars and sliding contacts are provided between the first and second members and between the second and third members to conduct electricity from externally of the cross member to the actuator means.

10. A chassis as claimed in claim 1, wherein low friction pads are provided between the first member and the second member and between the second member and the third member.

11. An invalid hoist having a chassis comprising two legs extending in parallel or substantially parallel spaced apart relationship and a cross member connecting the two legs together, the cross member comprising first, second and third members, the first member supporting a mast, actuator means for extending and retracting the second and third members relative to one another and means for defining the position of the first member relative to the second and third members, said defining means comprising two pinion gears supported for rotation by one of the members and two racks supported respectively by the other two members.

12. An invalid hoist as claimed in claim 11, wherein a lifting arm is provided on the mast.

13. An invalid hoist as claimed in claim 12, wherein the lifting arm has a sling hanger at its free end.

14. A chassis comprising two legs extending in parallel or substantially parallel spaced apart relationship and a cross member connecting the two legs together, the cross member comprising first, second and third members, actuator means for extending and retracting the second and third members relative to one another and means for defining the position of the first member relative to the second and third members, wherein the first, second and third members are tubular members, and wherein the second member is telescopically extendible and retractable in the first member, and the third member is telescopically extendible and retractable in the second member.

* * * * *